United States Patent [19]

Howell

[11] 4,292,612

[45] Sep. 29, 1981

[54] REMOTELY SWITCHABLE RESIDENTIAL CIRCUIT BREAKER

[75] Inventor: E. Keith Howell, Simsbury, Conn.

[73] Assignee: General Electric Company, New York, N.Y.

[21] Appl. No.: 94,021

[22] Filed: Nov. 14, 1979

[51] Int. Cl.[3] ..... H01H 75/00; H01H 77/00; H01H 83/00

[52] U.S. Cl. ..... 335/14; 335/20; 335/173; 335/175

[58] Field of Search ..... 335/14, 20, 6, 172, 335/174, 175, 164, 165, 173

[56] References Cited

U.S. PATENT DOCUMENTS

| | | | |
|---|---|---|---|
| 4,164,719 | 8/1979 | Young et al. | 335/14 |
| 4,167,716 | 9/1979 | Horn | 335/14 |
| 4,178,572 | 12/1979 | Gaskill et al. | 335/14 |
| 4,223,288 | 9/1980 | Stiner | 335/20 |

*Primary Examiner*—Harold Broome

*Attorney, Agent, or Firm*—Robert A. Cahill; Walter C. Bernkopf; Philip L. Schlamp

[57] ABSTRACT

The contacts of a conventional molded case residential circuit breaker are opened and closed in relay fashion by a remotely controllable operator module. The operator module, utilizing the compliance of the breaker operating mechanism in its ON condition, acts directly on the breaker movable contact arm to effect a separation of the movable contact from the stationary contact sufficient to switch rated current.

6 Claims, 7 Drawing Figures

REMOTELY SWITCHABLE RESIDENTIAL CIRCUIT BREAKER

BACKGROUND OF THE INVENTION

The present invention relates generally to electric circuit breakers and particularly to a remotely controllable residential circuit breaker-relay combination utilizing a single set of circuit interrupting contacts.

As electrical power distribution systems become more sophisticated, greater demands are being placed on the components thereof. This trend is most evident in industrial power distribution systems, where industrial circuit breakers are being equipped with more and more accessory functions. That is, industrial circuit breakers are increasingly being called upon to perform control and signal functions, in addition to their traditional circuit protective function. Thus, industrial circuit breakers are equipped with motor operator mechanisms to afford the capability of opening and closing the breaker contacts from a remote location automatically in response to conditions unrelated to circuit protection.

Recently, due largely to the concern for energy conservation, increasing emphasis is being placed on adding sophistication to residential and office power distribution systems. Computer-aided management of energy consumption in large buildings has been shown to be effective in dramatically reducing energy costs. A related concern is the limited electrical generating capacity which, at least in certain localities, is outstripped by consumer demands during peak times. Thus, utilities are considering the feasibility of widespread load shedding schemes enabling the utilities to controllably shed on a mass scale non-critical residential and office branch circuits at the onset of peak demand periods. Obviously, with such load shedding schemes in place, not only is energy conserved, but utilities and consumers alike are saved the high expense of additional generating capacity merely to satisfy the peak demand periods which typically are only several hours in duration.

To accommodate such a load shedding scheme, it is necessary to incorporate in each of the non-critical residential and office branch circuits to be shed some sort of remotely controlled switching device actuatable by the utility independently of the consumer to switch out the branch circuit load at the onset of a peak demand period and then switch in the branch circuit load when the peak demand period has subsided. Obviously, a conventional relay could be implemented to function as such a remotely controllable switching device to be selectively actuated in response to utility generated signals transmitted over power lines or phone lines. In many instances however, the branch circuits to be shed are already equipped with a form of switching device, that is, a circuit protective, residential molded case circuit breaker. It would therefore be manifestly desirable, both from standpoints of component cost and installation expediency, to adapt a residential molded case circuit breaker to serve both as a circuit protective device and a remotely controllable switching device.

It is accordingly an object of the present invention to provide a combination circuit protective residential circuit breaker and remotely controllable switching device.

An additional object is to provide a combination automatic residential circuit breaker-switching device of the above character which utilizes a single set of circuit interrupting contacts.

A further object of the present invention is to provide a circuit breaker-switching device combination of the above character, wherein the single set of circuit interrupting contacts are the stationary and movable contacts of a conventional residential molded case circuit breaker.

Another object of the present invention is to provide a circuit breaker-switching device combination of the above character wherein the remotely controlled actuation thereof may be manually over-ridden.

A still further object is to provide a circuit breaker-switching device combination of the above character which is conveniently installable in existing service entry panelboards.

Other objects of the invention will in part be obvious and in part appear hereinafter.

SUMMARY OF THE INVENTION

In accordance with the present invention, there is provided a residential molded case circuit breaker which is equipped with a remotely controllable operator module adapting the circuit breaker to function both as a circuit protective device and as a remotely controllable switching device. Both functions are achieved utilizing a single set of circuit interrupting contacts, specifically the circuit breaker stationary and movable contacts. Basically, the circuit breaker comprises, in conventional fashion, a spring-powered, toggle-type operating mechanism including a manual operating handle, a movable contact arm, a cradle or trigger, and a tension spring. The cradle is latched in a reset position by a trip mechanism including an electromagnet and a bimetal. When the cradle is reset, the handle is manipulated to articulate the operating mechanism between its ON and OFF conditions thereby swinging the movable arm to bring the breaker movable contact carried adjacent its free end into and out of electrical contacting engagement with the breaker stationary contact. During such manual operation, the tension spring acts on the contact arm to provide contact engagement and dis-engagement in quick-made, quick-break fashion.

In the event of an overcurrent condition, the trip mechanism responds automatically to unlatch the cradle which then swings to a tripped position as the mechanism spring discharges to abruptly swing the movable arm to a tripped open position separating the movable contact from the stationary contact.

As a signal feature of the present invention, the operator module acts directly on the movable contact arm and, by taking advantage of the inherent compliance of the breaker operating mechanism in its ON condition, thereby achieves contact separation without articulating the operating mechanism. That is, the mechanism tension spring simply yields to accommodate the current switching gap created between the breaker movable and stationary contacts by the operator module. When the operator module removes its contact separating force on the contact arm, the bias of the mechanism spring re-establishes contact engagement to restore electrical service to the branch circuit in which the circuit breaker is installed.

The operator module includes an opening solenoid having its plunger linked to drive an actuating mechanism pursuant to translating a switch actuating element into contact separating engagement with the breaker movable contact arm when solenoid energization is initiated from a remote location. Preferably the actuating mechanism is bistable such that it assumes a stable switch open condition capable of sustaining this current switching gap without continued energization of the solenoid. An additional, closing solenoid is provided with its plunger linked to the actuating mechanism such that, when momentarily energized from a remote location the actuating mechanism is drivingly returned to its other stable switch closed condition with its switch actuating element in disengaged relation with the movable contact arm. The breaker mechanism spring is then free to reclose the breaker contacts.

As an additional feature of the present invention, the actuating mechanism is equipped with a manual override effective to permit reclosure of the breaker contacts after the opening solenoid has been pulsed to separate the breaker contacts and before the closing solenoid has been pulsed to reclose the breaker contacts. This manual override, in the disclosed embodiment of the invention, takes the form of a spring which becomes empowered to convert the actuating mechanism from its switch open condition to its switch closed condition only when the circuit breaker operating mechanism is articulated from its ON condition to its OFF condition by the handle. The operating mechanism can then be articulated back to its ON condition to restore electrical service to the branch circuit.

The invention accordingly comprises the features of construction and arrangement of parts which will be exemplified in the construction hereinafter set forth, and the scope of the invention will be indicated in the claims.

For a better understanding of the nature and objects of the invention, reference should be had to the following detailed description taken in conjunction with the accompanying drawings, in which.

Like reference numerals refer to corresponding parts throughout the several views of the drawings.

DETAILED DESCRIPTION

Figure 1:
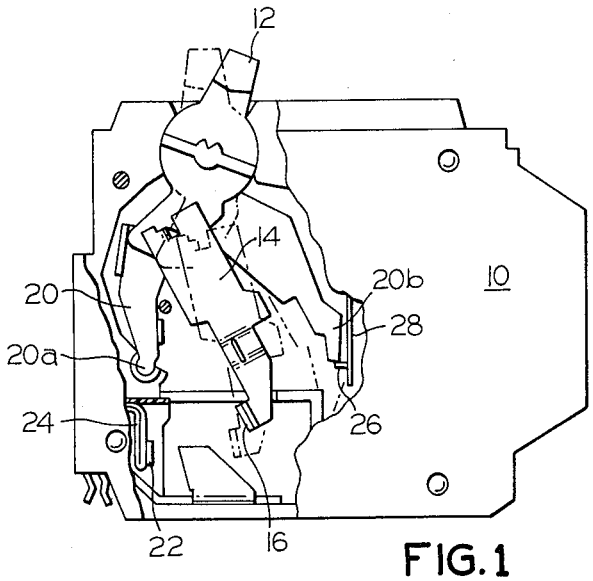
FIG. 1 is a side elevational view, partially broken away, of a conventional residential molded case circuit breaker to which the present invention is adapted.
Figure 4:
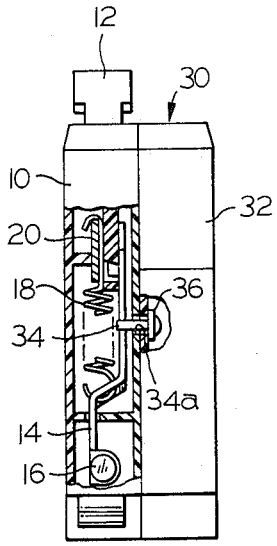
FIG. 4 is an end view, partially broken away, of the circuit breaker of FIG. 1, showing the manner of operatively coupling a remotely controllable switch operator module thereto.
Figure 2:
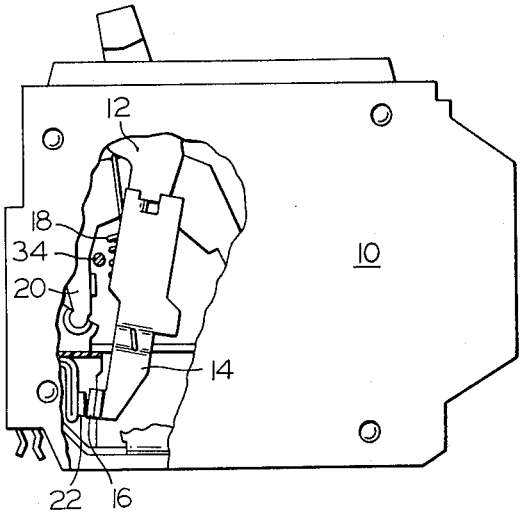
FIG. 2 is a side elevational view, partially broken away, of the circuit breaker of FIG. 1, seen in its closed or ON condition.
Figure 3:
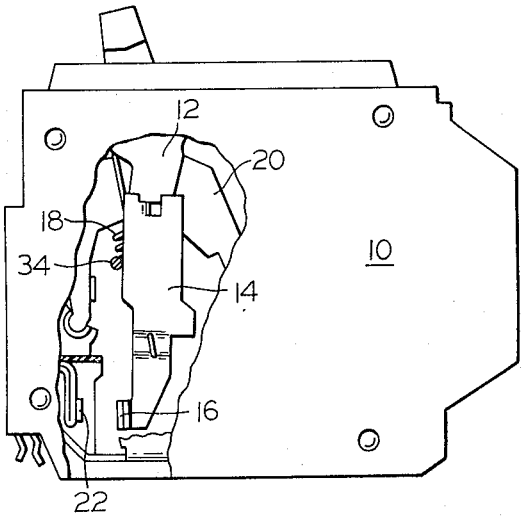
FIG. 3 is a side elevational view, partially broken away, of the circuit breaker of FIGS. 1 and 2, seen in its ON condition, but with its contacts separated to create a current switching gap therebetween.

Referring to the drawings, FIGS. 1 through 4 depict a molded case residential circuit breaker of known construction, such as that disclosed in commonly assigned U.S. Pat. No. 3,464,040 issued to D. B. Powell. This circuit breaker includes a molded insulative case 10 serving to enclose the breaker components and to pivotally mount an externally accessible manual operating handle 12. A movable arm 14 carries a movable contact 16 adjacent its lower end and is pivotally connected at its upper end to a depending portion of the handle. A tension operating mechanism spring 18, seen in FIGS. 2 through 4, is connected between the movable arm 14 and a trigger or cradle 20 pivotally mounted within the case 10 at 20*a*. A stationary contact 22 is carried by a depending inner portion of a line strap 24 which is configured at its outer end to provide a line terminal stab connector adapted for plug-on electrical engagement with a line stab (not shown) in a circuit breaker service entry panelboard.

Cradle 20 is normally retained in its solid line, reset position seen in FIG. 1 by a latch 26 in the form of a tab struck from a depending armature 28 pivotally mounted at its upper end within case 10. A spring (not shown) biases the depending portion of the armature to the left to insure that the latch is in position to engage a tip 20*b* of cradle 20 and thus releasably retain the breaker operating mechanism in its reset or untripped condition.

As disclosed in the above-noted patent, armature 28 is included in a thermal-magnetic trip mechanism operating in response to an overcurrent condition to convert the breaker operating mechanism from its ON condition seen in FIG. 2, with the breaker contacts in engaging relation, to a tripped condition seen in phantom line in FIG. 1, with the movable contact disposed in widely spaced relation to the stationary contact. This tripping action is achieved in the following manner. When the cradle 20 is latched in its reset position and the operating handle 12 is pivoted to its counterclockwise-most position, the breaker operating mechanism assumes its ON condition seen in FIG. 2. Under these circumstances, the line of action of mechanism spring 18 is to the left of the pivotal connection between the handle and the movable arm 14, such as to exert a clockwise movement on the arm and thereby achieve electrical contacting engagement of movable contact 16 with stationary contact 22. Upon tripping of the breaker operating mechanism by the trip mechanism, latch 26 releases cradle 20, which is then freed to rotate in the clockwise direction under the urgence of mechanism spring 18 to its phantom line, tripped position seen in FIG. 1. In the process, the line of action of mechanism spring 18 is swung to the right of the handle-movable arm pivotal connection, thereby imposing a counterclockwise movement on the movable arm effective in pivoting the movable arm to its phantom line tripped open position with movable contact 16 in widely spaced relation to stationary contact 22. In the process, handle 12 assumes its phantom line, trip indicating position seen in FIG. 1 intermediate its solid line OFF condition of FIG. 1 and its ON position of FIG. 2. To restore the breaker operating mechanism to its reset condition, handle 12 is simply pivoted to its clockwise-most OFF position seen in FIG. 1, in the process pivoting cradle 20 in the counterclockwise direction to elevate its tip 20*b* back into latching engagement with latch 26.

While the breaker operating mechanism is in its reset condition, handle 12 may be pivoted to manually open and close the breaker contacts. From FIG. 1, it is seen that when handle 12 is pivoted to its clockwise-most, OFF position seen in solid line, the line of action of the mechanism spring is to the right of the handlemovable arm pivotal connection, such as to pivot the movable arm in the counterclockwise direction to its solid line open position. As handle 12 is pivoted to its counterclockwise-most ON position seen in FIG. 2, the line of action of the mechanism spring passes from right to left through the pivotal connection between the handle and the movable arm, with the result that the spring acts to pivot the arm in the clockwise direction to bring movable contact 16 into electrical contacting engagement with stationary contact 22. It will be appreciated that this toggling action of the handle and movable arm effects opening and closing of the breaker contacts in quick-break, quick-make fashion.

In accordance with a signal feature of the present invention, switching action of the breaker contacts is effected without articulating the breaker operating mechanism. This is achieved by utilizing the inherent compliance of the breaker operating mechanism while it is in its ON condition. That is, I have discovered that the movable arm can be forcibly pivoted in the counterclockwise direction from its clockwise-most closed circuit position of FIG. 2 to create a contact gap sufficient to switch rated current without disturbing the ON condition of the breaker operating mechanism. Mechanism spring 18 simply stretches to accommodate this externally imposed current switching gap between the movable and stationary breaker contacts, as illustrated in exaggeration in FIG. 3. This switching gap need not be great, inasmuch as, for example, a 30 mil gap between movable contact 16 and stationary contact 22 is sufficient to interrupt or switch a 30-amp load current.

To controllably effectuate this switching gap in accordance with the disclosed embodiment of the present invention, an operator module 30, housed in a molded insulative case 32, is secured in side-by-side relation with breaker case 10 as seen in FIG. 4. A pin 34 is introduced from the operator module case 32 into the breaker case 10 through registered, elongated openings **34*a* provided in the case sidewalls for disposal in engaging relation with the front edge of movable arm 14. As will be seen, pin 34 is reciprocated by an operator module actuating mechanism pursuant to selectively achieving current switching movement of movable contact 16**.

Figure 5:
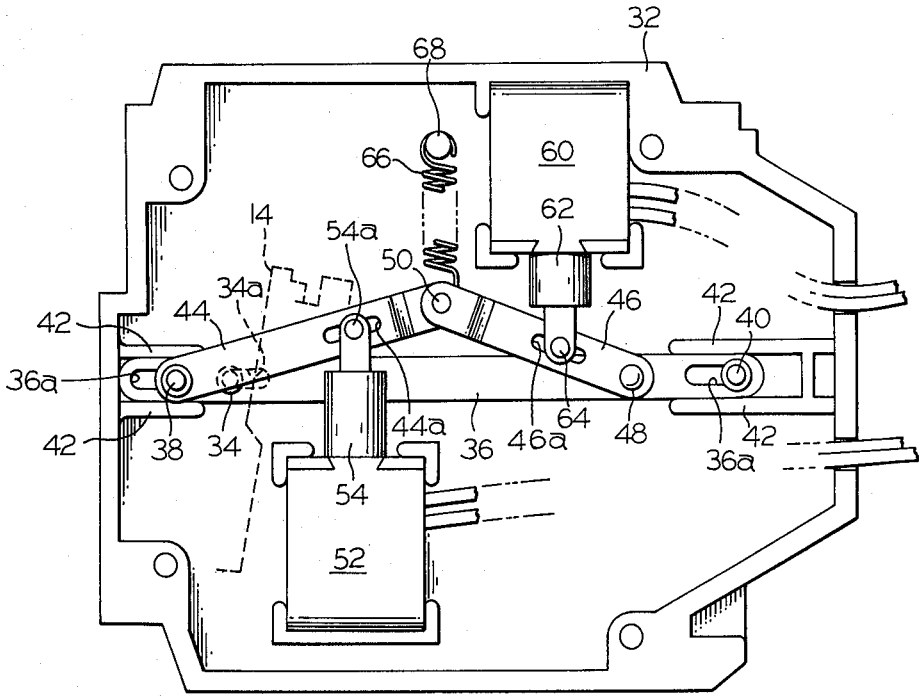
FIG. 5 is a side elevational view of an operator module as adapted to the circuit breaker in the manner of FIG. 4; the operator module including an actuating mechanism seen in its switch closed stable condition.
Figure 6:
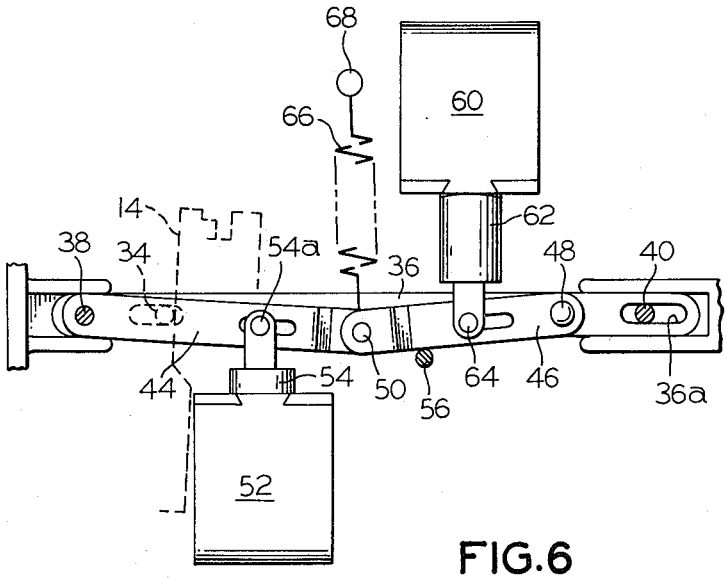
FIG. 6 is a side elevational view of the actuating mechanism of FIG. 5, seen in its switch open stable condition.
Figure 7:
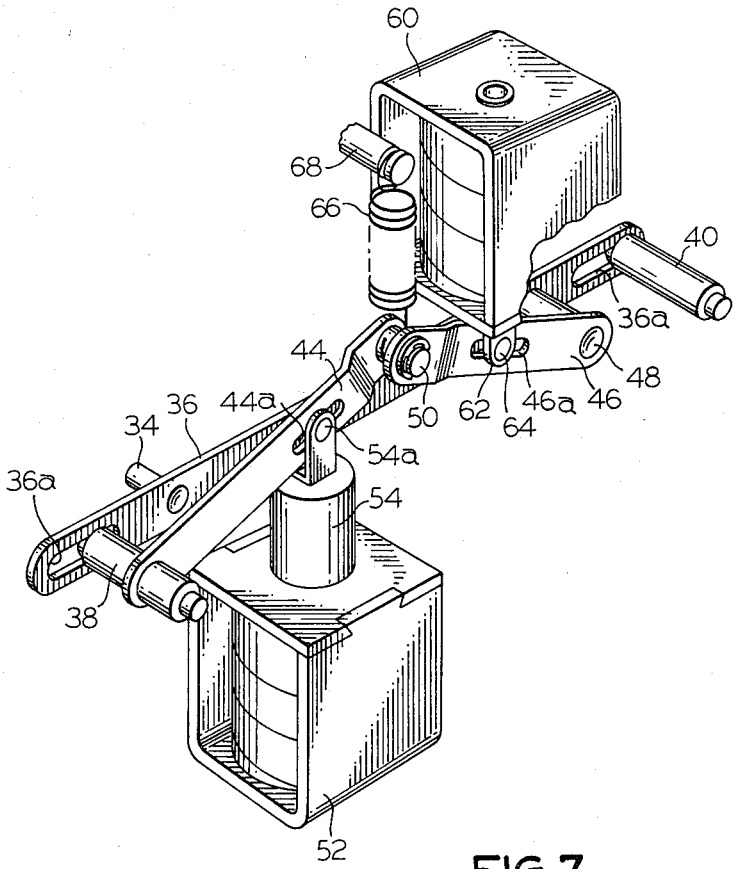
FIG. 7 is a perspective view of the actuating mechanism of FIGS. 5 and 6.

Turning to FIGS. 5 through 7, there is shown a representative operator module actuating mechanism applicable to the present invention. It will be appreciated that other forms of actuating mechanisms capable of implementing the features of the present invention will readily occur to those skilled in the art.

In the actuating mechanism embodiment disclosed herein, pin 34 is mounted by a slide 36 having elongaged slots **36*a* formed in each end for receiving pins 38 and 40 fixably mounted between the operator module case sidewalls. These pins, together with ribs 42 molded into the module case 32, serve to mount slide for reciprocating toggle linkage consisting of a first elongaged link 44 pivotally connected at its left end to stationary pin 38 and a second elongated link 46 pivotally connected at its right end to a pin 48 carried by the slide. The other ends of these toggle links are pivotally interconnected by a knee pin 50. To motivate toggling action of this toggle linkage, there is provided an opening solenoid 52 having a plunger 54 carrying at its free upper end a pin 54*a* which is received in an elongaged slot 44*a* formed in toggle link 44**.

From the description thus far, it is seen that when opening solenoid 52 is energized to pull in its plunger 54, the toggle linkage is pulled downwardly toward its fully straightened configuration. Since the location of the left end of toggle link 44 is fixed by pin 38, the straightening action of the toggle linkage exerts a force on slide 36 via pin 48 driving the slide to the right. Pin 34 is thus moved rightwardly, in the process picking up the front edge of the breaker movable contact arm 14 which is then pivoted in the counterclockwise direction to impose the switching gap between the breaker movable contact 16 and the breaker stationary contact 22 illustrated in FIG. 3. Preferably, the travel of opening solenoid plunger 54 is sufficient to pull the toggle links 44, 46, through center, as illustrated in FIG. 6. Under these circumstances, the bias of the breaker operating mechanism spring 18 acting in the direction to reclose the breaker contacts, exerts a force on slide 36 tending to collapse the toggle linkage in the downward direction. Further downward collapse of the toggle linkage beyond its configuration shown in FIG. 6 is prevented either by the bottoming out of opening solenoid plunger 54 or by the provision of a stop 56 carried by the operator module case 32. It is thus seen that, under these circumstances, the operator module actuating mechanism has achieved a stable switch open condition effective in sustaining the breaker contacts in separated relation without continued energization of opening solenoid 52.

To switchingly reclose the breaker contacts, the operator module actuating mechanism further includes a closing solenoid 60 having a plunger 62 linked to the toggle linkage by a pin 64 operating in an elongated slot **46*a* formed in toggle link 46. When this closing solenoid 60 is energized, its plunger is pulled in to, in turn, pull the toggle linkage through center into an upwardly collapsed configuration. Slide 36 is thus translated to the left, moving its pin 34 leftward out of engaging relation with braker movable contact arm 14. Breaker mechanism spring 18 swings the movable contact arm in the clockwise direction to bring movable contact 16 back into engaging relation with stationary contact 22**, and electrical service is restored to the branch circuit in which the circuit breaker is installed. In this condition, the operator module actuating mechanism is decoupled from the breaker operating mechanism, and thus the upwardly collapsed configuration of the toggle linkage is sustained as a stable switch closed condition without continued energization of the closing solenoid.

As an additional feature of the present invention, there is provided a manual override which, in the illustrated embodiment, takes the form of a light tension spring 66 hooked at its lower end to knee pin 50 of the toggle linkage and at its upper end to a stationary post 68. Thus, this spring acts to bias the toggle linkage to its upwardly collapsed configuration, i.e., switch closed condition, seen in FIG. 5. From FIG. 6, it is seen that when opening solenoid 52 is energized to pull the toggle linkage through center to its slightly downwardly collapsed configuration, effecting separation of the breaker contacts, spring 66 is charged. However, the force of this spring is not sufficient to overcome the force of the breaker mechanism spring 18 acting to retain the toggle linkage in its downwardly collapsed configuration of FIG. 6. However, if the circuit breaker is operated by its handle 12 to its OFF condition translating movable arm 14 to its solid line position seen in FIG. 1, the overpowering bias of the mechanism spring 18 is removed from the operator module actuating mechanism. That is, movable arm 14 is removed from engagement with the actuating mechanism pin 34, despite its rightwardmost position. Spring 66 then becomes empowered to pull the toggle linkage back through center to its upwardly collapsed configuration. Slide 36 is thus translated leftward, and pin 34 is moved leftward to its inactive position seen in FIGS. 1 and 2. Under these circumstances, the circuit breaker can then be closed via handle 12 to bring the movable contact 16 back into engagement with stationary contact 22, re-establishing electrical service to the branch circuit in which the circuit breaker is installed. It is thus seen that the consumer is afforded, by virtue of the present invention, the capability of overriding the load shedding action of opening solenoid 52.

It is seen from FIGS. 1 and 2 that when the toggle linkage is in its upwardly collapsed configuration to position pin 34 in its leftward-most, inactive position, it does not interfere with manual operation of the circuit breaker to open and close its contacts, as well as the tripping action thereof to abruptly open the breaker contacts in the event of an overcurrent condition.

As was mentioned, the bistable character of the actuating mechanism accommodates momentary energization of the opening and closing solenoids. To ensure that these energization intervals are of sufficient duration to effect complete articulation of the actuating mechanism from one stable condition to the other, it will be appreciated that the actuating mechanism may be adapted to actuate normally closed switches wired in the solenoid energization circuits such as to terminate solenoid energization upon assuming each of its stable conditions. Moreover, the actuating mechanism may be adapted to actuate a suitable indicator upon assuming its switch open condition, such as a flag viewable through a window in the operator module case, to notify the consumer that, for example, the associated branch circuit load has been shed by the utility.

It will thus be seen that the objects set forth above, among those made apparent in the preceding description, are efficiently attained and, since certain changes may be made in the above construction without departing from the scope of the invention, it is intended that all matter contained in the above description or shown in the accompanying drawings shall be interpreted as illustrative and not in a limiting sense.

Having described my invention, what I claim as new and desire to secure by Letters Patent is:

1. A remotely switchable circuit breaker comprising, in combination:

A. a molded, insulative breaker case;

B. a stationary breaker contact within said breaker case;

C. a movable breaker contact within said breaker case;

D. an over-center toggle-type breaker operating mechanism within said breaker case including (1) a manual operating handle, (2) a movable arm carrying said movable contact and pivotally connected with said handle, (3) a cradle, and (4) a mechanism spring acting between said cradle and said arm, with said operating mechanism in its ON condition, said spring biasing said arm in one direction to a closed circuit position with said movable contact in electrical contacting engagement with said stationary contact, and, with said operating mechanism in its OFF condition, said spring biasing said arm in the opposite direction to bring said movable contact to an open circuit position in displaced relation to said stationary contact; and E. a molded, insulative module case disposed in side-by-side relation with said breaker case; and F. an operator module within said module case and including a remotely controllable actuating mechanism having an element reaching laterally into said breaker case and, with said breaker operating mechanism in its ON condition, engagingly moving said arm in said opposite direction away from its closed circuit position against the bias of said spring to create a current switching gap between said movable and stationary breaker contacts.

2. The remotely switchable circuit breaker defined in claim 1, wherein said actuating mechanism is a bistable mechanism having a stable switch closed condition and a stable switch open condition creating said current switching gap, said actuating mechanism further including switch opening solenoid means operative in response to momentary electrical energization initiated from a remote location to forcibly convert said actuating mechanism from its switch closed condition to its switch open condition.

3. The remotely switchable circuit breaker defined in claim 2, wherein said actuating mechanism further includes switch closing solenoid means operative in response to momentary electrical energization initiated from a remote location to forcibly convert said actuating mechanism from its switch open condition to its switch closed condition disengaging said element from said arm.

4. The remotely switchable circuit breaker defined in claims 2 or 3, wherein said actuating mechanism includes an over-center toggle linkage.

5. The remotely switchable circuit breaker defined in claim 2, wherein said actuating mechanism further includes means accommodating local manual overriding of said switch open condition to enable said mechanism spring to bias said movable arm to its closed circuit position.

6. The remotely switchable circuit breaker defined in claim 5, wherein said overriding means consists of an override spring acting to bias said actuating mechanism to its switch closed condition when said breaker operating mechanism is manually converted from its ON condition to its OFF condition by said handle.

* * * * *